United States Patent [19]

McLain

[11] Patent Number: 4,855,577

[45] Date of Patent: Aug. 8, 1989

[54] NAVIGATIONAL AND YACHT RACING CALCULATOR

[76] Inventor: Philippe H. McLain, 510 Harden St., Columbia, S.C. 29205

[21] Appl. No.: 163,617

[22] Filed: Mar. 3, 1988

[51] Int. Cl.[4] ..... G06C 3/00

[52] U.S. Cl. ..... 235/78 N; 235/61 NV; 235/88 N

[58] Field of Search ..... 235/61 NV, 61 S, 61 V, 235/61 T, 78 R, 78 N, 88 R, 88 N

[56] References Cited

U.S. PATENT DOCUMENTS

| | | | |
|---|---|---|---|
| 2,433,984 | 1/1948 | DeVries | 235/78 N |
| 3,803,389 | 4/1974 | Yelverton | 235/78 N |
| 4,149,068 | 4/1979 | Simon | 235/78 R |
| 4,652,728 | 3/1987 | Galiana | 235/61 NV X |

*Primary Examiner*—B. R. Fuller

*Attorney, Agent, or Firm*—Renner, Kenner, Greive, Bobak, Taylor & Weber

[57] ABSTRACT

A navigational calculator (10) for establishing the ratios of time, or distance, to be spent on port or starboard tacks, respectively, during the maneuvering of a yacht to a windward destination. A plurality of disk members are carried on a central support (11). The first disk member (14) has a true wind indicator (30) imprinted thereon. The second disk member (15) has a compass rose (34) imprinted thereon. The third disk member (16) has a course indicator (35) and two sets (38 and 39) of tack ratio indicia imprinted thereon. The fourth and fifth disk members (18 and 19) have starboard and port heading indicators (46 and 55, respectively) imprinted thereon. The sixth disk member (20) has included tacking angle indicia imprinted thereon and a tack ratio indicator (61) alignable with one set (38) tack ratio indicia. The seventh disk member (21) has included tacking angle indicia imprinted thereon and a tack ratio indicator (66) alignable with the other set (39) of tack ratio indicia. An eighth disk member (79) may be rotatably supported beneath the first disk member (14). By making the eighth disk member (79) of lesser diameter than the first disk member (14), and by providing similar logarithmic scales (81 and 84, respectively) on each, the calculator (10) can incorporate a circular slide rule (85).

15 Claims, 6 Drawing Sheets

NAVIGATIONAL AND YACHT RACING CALCULATOR

TECHNICAL FIELD

The present invention relates generally to calculators. More particularly, the present invention relates to calculators which may be hand held and which are of the circular slide rule genre. Specifically, the present invention relates to circular slide rule type calculators that are adapted for use in conjunction with the navigation of yachts, particularly when said yachts are racing.

BACKGROUND OF THE INVENTION

The present invention relates to calculators that are capable of being hand held and which are particularly adapted for use on board a yacht, or sailboat (the two terms are used synonymously herein), while racing.

Yacht racing is perhaps one of the most complicated racing events designed by man. In most racing events the shortest route between two points is the fastest. This is definitely not true when racing yachts. Because of the primary limitation that a yacht is incapable of sailing directly into the wind and because of such other factors as localized weather cells, currents and tides, for example, a yacht is not always capable of sailing in a straight line between two points. In fact, the course of the race to be sailed by yachts that are racing is, when physically possible, selected to maximize at least the obstacle created by the fact that a yacht cannot sail directly into the eye of the wind.

The obstacles are present for every yacht, and that is part of the challenge which makes yacht racing so absorbing. Each participant must, therefore, pit not only his or her boat handling skill but also his or her wits, knowledge and intuition against the extent to which those attributes are possessed by the competitors.

Yacht racing courses fall into three general categories—i.e., custom, selective or fixed. Custom courses are those which have a stated configuration, and the rounding marks (buoys, piers or the like which will remain in a fixed location during that race) are set to delineate the course as closely as possible to the stated configuration. In addition to setting the marks so that the actual course wil closely emulate the stated configuration, the Race Committee also considers all the wind, water and other local environmental factors to determine the proper location for each mark. Custom courses are, perhaps, the most widely employed, and specific variations are known under such names as Gold Cup, Modified Gold Cup and Olympic courses.

Selective courses are those for which the Sailing Instructions specify the location of a number of rounding marks, and prior the beginning of the race the Race Committee announces the particular marks to be employed to delineate the course for that race.

Fixed courses are those defined by marks having locations which the Sailing Instructions also delineate in specific detail. The particular marks employed to define a course are not changed prior the race, and to that extent the course is fixed, but it is possible to delineate a number of fixed courses and then select which specific fixed course is to be sailed just prior the beginning of a race.

In addition to the three, general types of yacht racing courses, there are also two, general types of races—i.e., match races and fleet races. In match races only two yachts compete in any one race. The America's Cup race exemplifies a match race.

In fleet races there are virtually any number of yachts. The yachts may all fall into a single class (wherein the yachts are identical within stated rules for that class) or the yachts may be of widely different design and therefore be sailing under an accepted "handicap" measuring system which attempts to equalize dissimilar yachts so they can race each other fairly. Normally, such handicap systems apply a mathematical factor to the actual elapsed time required for each yacht to complete the course. A corrected time is calculated when the individual factor for each yacht is applied to that yacht's elapsed time, and the results of the race are determined by comparing corrected times. The fastest corrected time, rather than the fastest elapsed time, wins the race.

The present invention has utility for yachts racing in either type race, over virtually any type of course, but at least one aspect of the invention, as will hereinafter become apparent, is primarily appropriate only to non-handicap races. To understand the present invention in the environment of any type of course, for either type of race, one need merely understand the utility of the invention for any one combination thereof. Accordinly, the invention will be described as used in conjunction with a custom course (of the Gold Cup type) in a match race between two yachts of the same class. Such a description will demonstrate all aspects of the invention.

A Gold Cup course is delineated by three marks that are located at the apices of an imaginary, preferably equilateral, triangle which is oriented with considerable particularity relative to the direction of the wind anticipated for at least the start of the race. Ideally, the race will consist of six legs sailed in the following order: (1) a first windward leg; (2) a first reaching leg; (3) a second reaching leg; (4) a second windward leg; (5) a first running, or downwind, leg; and, (6) a third windward leg. Even such a capsulated description of a Gold Cup course should make it apparent that the windward legs are particularly important inasmuch as they are sailed at least three times.

A windward leg is defined as that leg of the course which lies between the two marks located in substantial alignment with the wind direction and which requires that the yacht sail against the direction of the wind. No yacht can sail directly into the wind, because the sails will not fill, as is necessary to impart a propelling force to the yacht. However, at some angular direction relative to the wind the sails to become quite effective, and when the yacht is being so sailed it is considered as being "close hauled" or as "beating to weather." Although each yacht is somewhat different, in general, a yacht can sail effectively into the wind on a heading of approximately 45° relative to the eye of the wind. By thus beating to weather along a successive series of starboard and port tacks a yacht can arrive at a point directly upwind of the starting point.

When the wind is coming over the right side of the yacht (as determined by reference to the right, or left, side of a person in the yacht who is facing the bow), and the sails are disposed, or, more nautically, "set" diagonally across the left side of the yacht, the yacht is on a starboard tack. When the wind is coming over the left side of the yacht, with the sails set across the right side of the yacht, the yacht is on a port tack.

By sailing a sequential series of starboard and port tacks a yacht will effectively move against the direction of the wind. To change from a starboard to a port tack, or vice versa, is called tacking. During the tacking maneuver, the bow of the boat passes through the eye of the wind while the sails change their disposition from one side of the yacht to the other. As the bow of the yacht heads more and more into the wind, the sails begin to luff and lose their ability to drive the boat, but if the yacht had sufficient speed at the beginning of the maneuver, and if the maneuver is carried out smoothly, the momentum of the yacht will swing the bow through the eye of the wind and beyond until the yacht is once more headed in a direction that will permit the wind to fill the sails and impart the necessary driving force to the yacht.

For a yacht which can sail most effectively into the wind at an angle of approximately 45° to the wind, tacking is accomplished through an included angle of approximately 90°. If such a yacht can consistently maintain its tacks through an included angle of 90°, or less, and does not overstand the next mark, as hereinafter more fully explained, it will likely sail the shortest total distance between the rounding marks which define the windward leg of the course being raced.

Even though race committees endeavor to set the windward mark (that rounding mark which defines the windward end of the windward leg in the course) directly to windward of the starting line, this idealized orientation is seldom accomplished. Wind shifts (a change in wind direction, often accompanied by a change in velocity) generally prevent the setting of a true windward mark. While this is not a serious problem when the windward, or weather, leg is relatively short (e.g., ¼ to ½ mile), it does become significant in races incorporating a windward leg of longer than a mile, and particularly in the situation where the weather mark is not visible from the starting line. Under these circumstances, the Race Committee will post the compass headings, or directions, from the starting line to the windward mark, and from each mark to the subsequent marks of the course.

Continuing with an explanation of the windward leg, as deemed appropriate to facilitate an understanding of the present invention, for each yacht there are two imaginary lines extending from the windward, or weather, mark that are called "lay lines." The lay lines represent the paths, both starboard and port, over the water which permit a particular yacht, sailing close hauled, to fetch, and clear, the weather mark in the existing wind. As such, the lay lines are respectively parallel to the starboard and port courses of that yacht as it beats to windward. Thus, the lay lines are generally symmetrical relative to the direction of the true wind, and they diverge to leeward of the weather mark with the included angle between the lay lines being equal to the included angle through which the particular yacht can effect a tack. Inasmuch as the included angle is normally about 90° one can assume that the lay lines define a right triangle when combined with extensions of the starting line.

If a yacht is sailed outside of the area bordered by the lay lines, the yacht has "overstood" the weather mark. A yacht which overstands the mark will have to travel further than one which sails within the area included between the diverging lay lines—or even along the lay lines—and the yacht which so overstands the mark will, unless sailing significantly faster, reach the weather mark after a yacht that stays within the area bounded by the lay lines. In addition to just the number of times that a yacht must traverse the windward leg during a race, the potential for exceeding the shortest distance to the windward mark when sailing the windward leg is another reason why sailing the best possible windward leg is often so important to the outcome of a yacht race.

One should not, however, fall into the trap of thinking that a yachtsman should always sail to the closest lay line, make one tack and then sail blithely to the weather mark. After all, the lay lines change their location and angular disposition in each wind shift. Over the years, therefore, yachtsmen have developed the precept of not sailing to either lay line until relatively close to the weather mark. Here again, experience is all important, and the present invention can assist even the most experienced yachtsman.

Without elaborate facilities on board the yacht to plot the course, it has heretofore been extremely difficult to determine not only what are the most advantageous headings for tacks to the windward mark but also the ratio of the distance along which, or the time on which, the yacht must sail on one tack relative to the other tack. These difficulties are compounded when one is unable to see the windward mark from the location where the race is started. Moreover, it is often virtually impossible to determine whether a competing yacht is ahead or behind when the yachts are sailing a windward leg. Certainly, when one of the two yachts finally reaches the windward mark, when the yachts cross on different tacks or when yachts are sailing side-by-side on the same tack it is possible for those sailing on either yacht to determine whether it is leading or lagging the other yacht, but by and large it is not otherwise easy for those sailing on either yacht to determine, with any reasonable degree of certainty, whether another yacht sailing a windward leg is leading or lagging.

It should be understood that on a windward leg the yachts tend to be spaced rather windely apart, as one might expect with some yachts sailing on starboard tack and others sailing on port tack. When yachts are sailing on divergent tacks, they are sailing away from each other on headings that are generally perpendicular to each other. This tends to separate yachts sailing the windward leg, and inasmuch as the wind itself is never identical in either strength or direction at all locations across the surface of the water on which the race is being held a distant yacht may be gaining a definite advantage that may not be readily ascertained. For that reason each yachtsman desires to maintain a continuous assessment as to whether he is leading or lagging the competitors. If, for example, a yachtsman is aware that a competitor at a distant location is gaining, or moving ahead, it may be wise for the yachtsman to sail toward the competitor in an attempt to obtain the benefit of the more favorable wind conditions that appear to be present in proximity to the competitors location. Economical means for providing such information has not heretofore been readily available.

The above described difficulties in determining the relative position of competing yachts from aboard one of those yachts does not exist on those legs of a course other than the windward leg. On the other legs the yachts generally proceed along substantially a straight line between the marks defining those legs so that relative position can be readily ascertained simply by noting relative position.

SUMMARY OF THE INVENTION

It is, therefore, one of the primary objects of the present invention to provide an improved navigational calculator for providing windward course information and data to a yachtsman.

It is another object of the present invention to provide a calculator, as above, by which a yachtsman can determine the time and/or distance to be spent on each tack when sailing to windward, expressed as a ratio, and thereby prevent the yachtsman from inadvertently overstanding the windward mark.

It is a further object of the present invention to provide a calculator, as above, by which a yachtsman can determine the most efficient headings by which to sail the windward leg.

It is yet another object of the present invention to provide a calculator, as above, by which a yachtsman can determine the position of his yacht relative to other yachts sailing the same windward leg.

It is a still further object of the present invention to provide a calculator, as above, which is in the configuration of a circular slide rule and may be manually operated.

It is an even further object of the present invention to provide an improved, manually operated, navigational calculator, as above, wherein a plurality of disk members can be manipulated to establish: the difference between the true wind direction and the course direction; the appropriate compass headings for port and starboard tacks; and, the port and starboard tack ratios by which to determine the time to be spent, or the distance to be sailed, on each tack.

It is an additional object of the present invention to provide an improved, manually operated, navigational calculator, as above, which can also serve as a valuable learning aid for the novice sailor.

It is still another object of the present invention to provide an economical method for determining the tack ratios by which most effectively to traverse a windward leg of a yacht race as well as for determining the relative positions between competing yachts sailing the same windward leg.

These and other objects of the invention, as well as the advantages thereof over existing and prior art forms, which will be apparent in view of the following detailed specification, are accomplished by means hereinafter described and claimed.

As will become apparent, the present invention assists the helmsman, or navigator, of a yacht to determine the best course to the weather mark. This is particularly useful when the weather mark is not visible or is hidden because of distance, fog, darkness, high seas or other obstructions. By knowing the true wind direction, the compass heading to the weather mark, and the included angle through which the yacht must normally tack to change directions between sailing close hauled to starboard and close hauled to port, or vice versa, the optimal starboard and port headings as well as the starboard and port tack ratios can be determined.

The tack ratios represent the relative ratio of the distances to be traveled (or times to be spent) on both starboard and port tacks to reach the weather mark while traveling the shortest distance. As such, were a yacht capable of travelling in a straight line between the two marks, the relative ratio would be equal to 1.0.

In general, an exemplary calculator embodying the concepts of the present invention may utilize seven disk members carried on a supporting means. Three of the seven disk members preferably have progressively smaller outer diameters, with the largest diameter disk member being behind the other two disk members. The two progressively smaller disk members are frictionally engaged with each other and with the third disk member that may preferably be non-rotatably secured to the supporting means.

These three disk members store, and/or present, information. Specifically, one of those three disk members presents a compass rose, and the other two of those three disk members present indicators, such as arrows, which are independently, and selectively, positionable to align with the direction of the true wind and the direction to the weather mark, including the reciprocal of that direction, as those directions appear on the compass rose. The decimal values for the sine or cosine of the angles between 0° and 90° are also appropriately presented on at least one of those three disk members.

The other four disk members are generally of irregular peripheral configuration with two of those four disk members each having an extension that projects radially outwardly beyond the outermost periphery of the other two of those four disk members.

Two of the four non-circular disk members designate the desired port and starboard headings, respectively, and the other two of those four disk members display the port and starboard tack ratios, respectively, as well as the indicia for the included tacking angle.

The included tacking angle—i.e., the angle between close hauled port and starboard headings—is established prior to beginning the leg toward the windward mark, is based upon the experience of the sailors manning the yacht and is predicated upon the sail effectiveness considering the sea and wind conditions anticipated along the windward leg.

The compass heading to the windward mark is usually provided by the Sailing Instructions when the windward mark cannot be seen from the starting line, but if that information has not been supplied, and if the windward mark can be seen, the helmsman can readily determine the compass heading to the windward mark either before the race begins or as the helmsman begins that leg. The wind direction may also be readily determined as the yachtsman begins the windward leg. Two other parameters, that are known or can be determined, are the boat speed over the bottom and the distance to the windward mark. However, knowing the distance to the windward mark is not critical to the use of a calculator embodying the present invention.

With the aforesaid information, the most effective close hauled starboard and close hauled port tack headings, as well as the starboard and port tack ratios, can be determined from the calculator. Having determined those parameters, and if the length of the windward leg is known, the yachtsman can establish the total time and/or distance required to sail to the windward mark and the amount of time and/or distance to remain on each tack. The necessary "timing" can be accomplished through the use of a timer such as a stopwatch and by recording the cumulative time sailed on each tack. Similarly, the distance sailed on each tack can be determined by a log meter, and it would be appropriately recorded.

A particularly convenient device for recording the time and/or distance is one in which the cumulative time and/or distance on both tacks is displayed simultaneously, and which would include a mechanism that automatically activates the accumulation of the time and/or distance when the boat changes tacks. The automatic change can be accomplished through the use of a mercury switch or similar, self actuating device which will actuate one timer, or log meter, while deactuating the other during a tacking maneuver. Because a yacht virtually always heels, or lists, to leeward while the yacht is on a tack, a change in the switch condition will occur as the yacht changes tacks. This device will, without human intervention, keep an accurate account of the time or distance on each tack and automatically change the recording instruments between tacks.

One exemplary embodiment of a calculator embodying the concepts of the present invention, together with one modification thereof, are shown by way of example in the accompanying drawings and are described in detail without attempting to show all of the various forms and modifications in which the invention might be embodied; the invention being measured by the appended claims and not by the details of the specification.

DESCRIPTION OF AN EXEMPLARY EMBODIMENT

Figure 1:
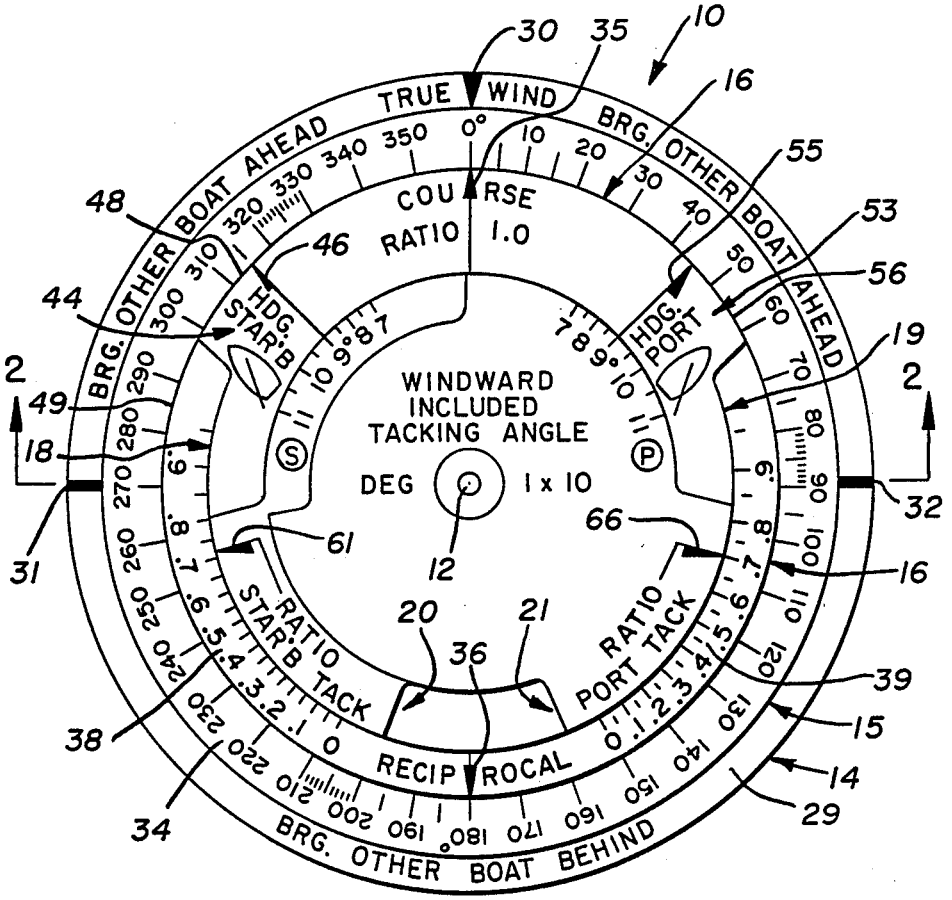
FIG. 1 is a top view of an exemplary calculator embodying the concepts of the present invention.

One representative form of a calculator embodying the concepts of the present invention is designated generally by the numeral 10 on the accompanying drawings. The representative calculator depicted in FIGS. 1 and 2 incorporates a central support, designated generally by the numeral 11, which includes a supporting post 12 that extends axially outwardly from a hub portion 13. Seven disk members 14, 15, 16, 18, 19, 20 and 21 are mounted on the central support 11.

The three, disk members 14, 15 and 16 are disposed between a flange 22 (which may be integrally formed with, and which extends radially outwardly from, the hub portion 13) and a retaining washer 23. The hub portion 13 may extend into the central aperture 24 of the retaining washer 23 after the disk members 14, 15 and 16 are stacked in position about the hub portion 13.

The disk member 14 is preferably bonded, or otherwise fixedly secured, to the flange 22 in a manner not depicted, but the disks 15 and 16 are rotatably mounted on the hub portion 13. Some means is preferably provided to assure that the disk members 15 and 16, though rotatably positionable, will tend to maintain the position in which they are set by the user. If desired, annular friction disks 25 and 26 may be interposed between the disk members 14, 15 and 16, respectively. A similar friction disk (not depicted) may also be interposed between the disk member 16 and the retaining washer 23, but the retaining washer 23 may, instead, present a friction surface 28 which engages the disk member 16. All the friction means serve to enhance the ability of the disk members 15 and 16 to remain in the relatively fixed positions set by the operator. On the other hand, the disk members 15 and 16 must be rotatable, about the hub portion 13, relative to each other and to disk member 14, although with some modest manual effort.

The disk member 14 is preferably circular with operating indicia imprinted on one side. The operating indicia appear on that face 29 which would normally be directed upwardly when the calculator is in use. As such, the face 29 is presented to the viewer in FIGS. 1 and 7. The operating indicia appearing on face 29 of disk member 14 include a true wind indicator, such as the arrow 30, that is positioned between the words TRUE and WIND. A pair of bearing marks in the form of bars 31 and 32 are each displaced 90° from the true wind arrow 30. The words BRG. OTHER BOAT AHEAD are preferably imprinted between the true wind arrow 30 and each bearing mark 31 and 32. Substantially diametrically opposite the true wind arrow 30, the words BRG. OTHER BOAT BEHIND are imprinted.

Capsulated operating instructions, which will be hereinafter more fully described, may well be imprinted on the reverse face 33 of the disk member 14, if desired. The imprinting can be accomplished by any of the conventional methods of printing or embossing.

The disk member 15 is also preferably circular and has a compass rose 34 imprinted thereon. The divisions of the compass rose 34 are set forth in 10° increments. Those familiar with a compass rose, as yachtsmen are, well know that the angular extent of the compass is 360°. The position designated with the "0" represents both the 0° and the 360° positions.

Figure 2:
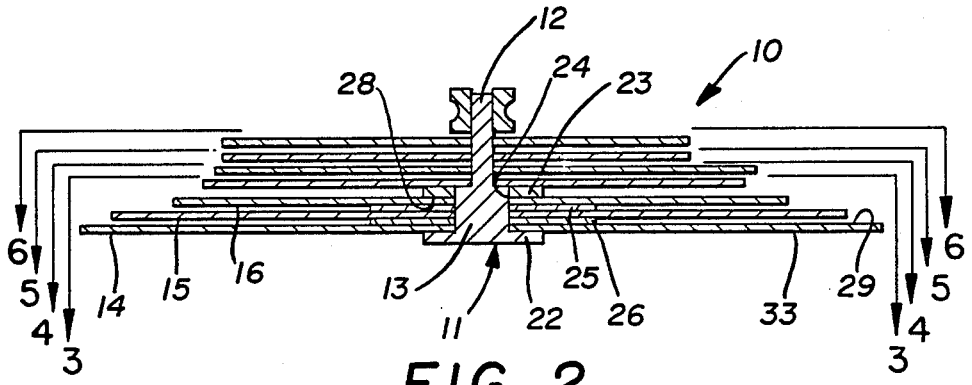
FIG. 2 is a cross sectional view taken substantially along line 2—2 of FIG. 1.
Figure 7:
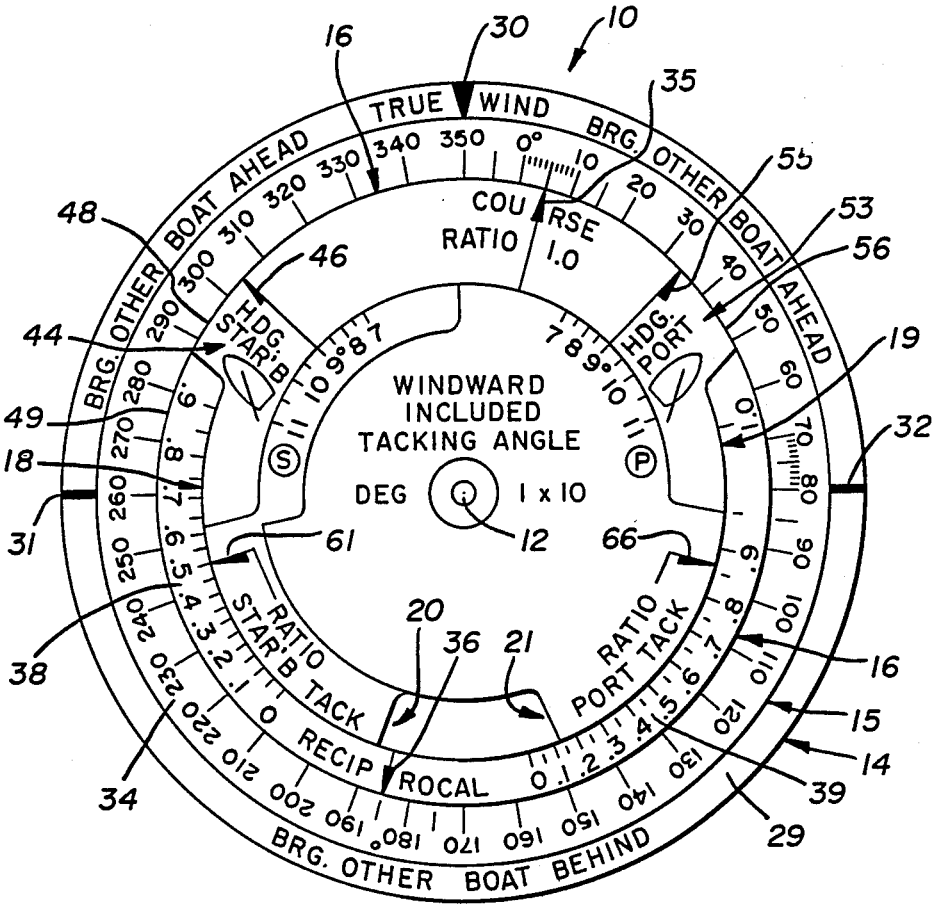
FIG. 7 is a view similar to FIG. 1 with the calculator reflecting a given set of conditions.

The disk member 15 is of lesser diameter than the disk member 14 so that the indicia on disk member 14 can be seen when the calculator 10 is held in the hand and disposed in the orientation depicted in FIGS. 1 and 7. As previously explained, the disk member 15 can be selectively rotated on the hub portion 13. As such, the compass rose 34 on disk member 15 can be rotated to align the true wind arrow 30 on disk member 14 with any point on the compass rose 34. The position of the true wind arrow 30 relative to the compass rose 34 will be maintained at the position set by the operator as a result of the frictional engagement of the disk member 15 with the friction disks 25 and 26 on either side thereof.

The disk member 16 is also preferably circular, and of even lesser diameter than the disk member 15. Disk member 16 is imprinted with indicia including a course indicator, such as the arrow 35, marked with the word COURSE, a reciprocal indicator, such as the arrow 36, marked with the word RECIPROCAL and two sets, indicated generally by the numerals 38 and 39, of the numerical values for the sine/cosine of angles from 0° through 90°. These values are disposed through 90° arcs with one set positioned on either side of the reciprocal arrow 36. As depicted, set 38 may be presented on the left side of the reciprocal arrow 36, as the calculator is viewed in FIG. 1, and the other set 39 may be presented from the right side of the reciprocal arrow 36. The indicia "RATIO 1.0" may also be imprinted in proximity to the course arrow 35 as a reminder that the straight line course is considered to be represented by a ratio of 1.0.

At this point it should be appreciated that the term "course" has two meanings to a yachtsman. First, the term may be employed to identify one of the categories by which the overal race may be designated. Second, the term may be employed to identify the direct path between two consecutive marks used to define a particular leg of the race. The two meanings are sufficiently distinct that one who is aware that two meanings exist will not be confused.

Figure 3:
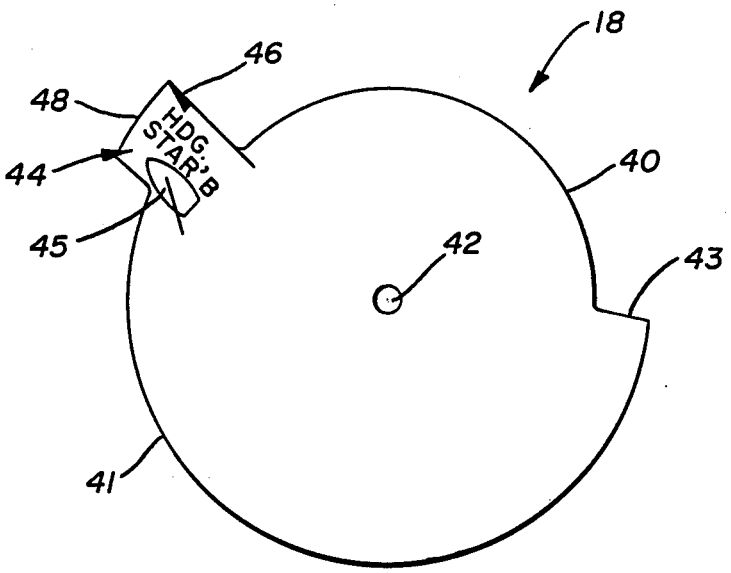
FIG. 3 is a view taken substantially along line 3—3 of FIG. 2 with the background disks omitted.
Figure 4:
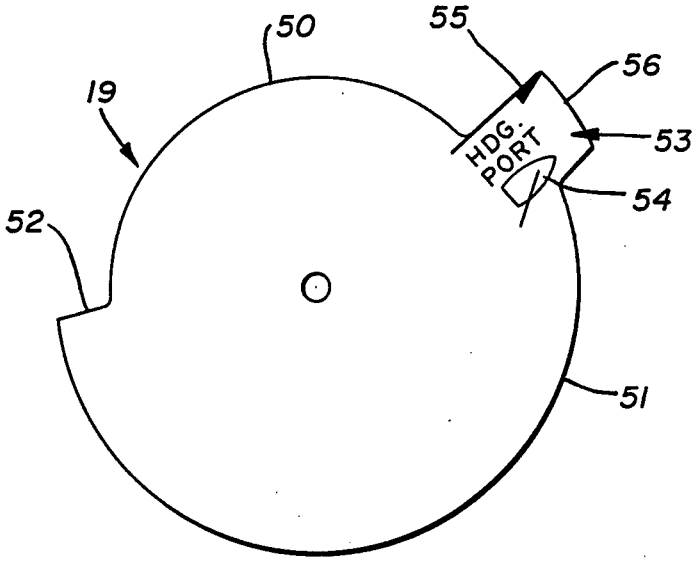
FIG. 4 is a view taken substantially along line 4—4 of FIG. 2, also with the background disks omitted.

Disk members 18 and 19, as individually depicted in FIGS. 3 and 4, respectively, are substantially mirror images of each other. Disk member 18 has first and second, generally semi-circular, peripheral edges 40 and 41 that are arcuate about a common center 42 (defined as the axis of the supporting post 12 when the disk member 19 is incorporated in the calculator 10), but with different radii. Specifically, the radius of first peripheral edge 40 is less than the radius of the second peripheral edge 41. One juncture of the peripheral edges 40 and 41 is defined by a radially oriented offset 43. The radius of peripheral edge 40 on disk member 18 is preferably sufficiently small to permit the arrow 35 on disk member 16, and the indicia imprinted in proximity thereto to be read. Similarly, the radius of the peripheral edge 41 on disk member 18 is preferably of sufficiently small diameter to permit the sets 38 and 39 of the sine/cosine values presented from disk member 16 to be read.

The opposite juncture of the peripheral edges 40 and 41 presents a radially extending protuberance 44. The stylized outline of a boat 45, a starboard heading arrow 46 and the indicia HDG. STAR'B are imprinted on the protuberance 44. The radially outer edge 48 of the protuberance 44 is of substantially the same radius as the peripheral edge 49 of the disk member 16 (as best represented in FIG. 1). Therefore, the head portion of the starboard heading arrow 46 may terminate adjacent the compass rose 34 imprinted on disk member 15.

Disk member 19 also has first and second, generally semi-cylindrical, peripheral eges 50 and 51 that are arcuate about the common center 42 (defined as the axis of the supporting post 12 when the disk member 19 is incorporated in the calculator 10) and joined in a mirror image to the manner described for disk member 18. That is, the radius of the first peripheral edge 50 is less than the radius of the second peripheral edge 51, and one juncture of the peripheral edges 50 and 51 is defined by a radially oriented offset 52. The radius of peripheral edge 50 on disk member 19 is preferably equal to the radius of the peripheral edge 40 on disk member 18. Similarly, the radius of the peripheral edge 51 on disk member 19 is preferably equal to the radius of the peripheral edge 41 on disk member 18.

The opposite juncture of the peripheral edges 50 and 51 on disk member 19 presents a radially outwardly extending protuberance 53. A stylized outline of a boat 54, a port heading arrow 55 and the indicia HDG. PORT are imprinted on the protuberance 53. The radially outer edge 56 of protuberance 53 also has substantially the same radius as the peripheral edge 49 of the disk member 16 in order that the port heading arrow 55 may also terminate adjacent the compass rose 34 imprinted on the disk member 15. The disks 18 and 19 can be rotated manually on the supporting post 12 so that the starboard heading arrow 46 and the port heading arrow 55 can be selectively, and individually, aligned with points of the compass rose 34 on disk 15.

Figure 5:
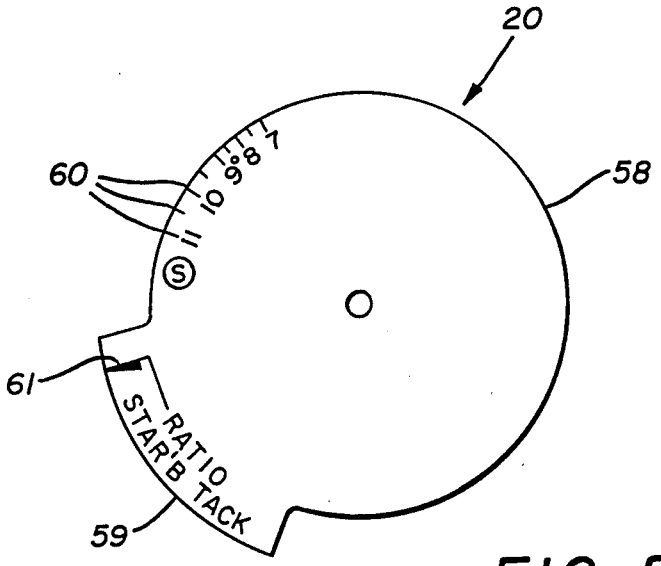
FIG. 5 is a view taken substantially along line 5—5 of FIG. 2, also with the background disks omitted.

Disk member 20, individually depicted in FIG. 5, has first and second arcuate, outer edges 58 and 59, respectively, with outer edge 58 being of greater arcuate extent but of lesser radius than the edge 59. The indicia comprising the letter "S" (employed as an abbreviation for "starboard") circumscribed by a circle is located adjacent one end of a plurality of radially oriented divisions 60, graduated in ten degrees increments, to represent the included tacking angle for the particular yacht with which the calculator 10 is being used. As such, the divisions 60 designate the angles 70° through 110°—again with the "0" unit designation being omitted to reduce clutter. The "S" circumscribed by a circle and the divisions 60 are imprinted in close proximity to the outer edge 58. A starboard tack ratio indicator, such as the arrow 61, and the indicia RATIO STAR'B TACK are imprinted in close proximity to the outer edge 59. The starboard tack ratio arrow 61 is utilized to point to values appearing in the sine/cosine set 38 on the disk 16, as will hereinafter be more fully explained.

Figure 6:
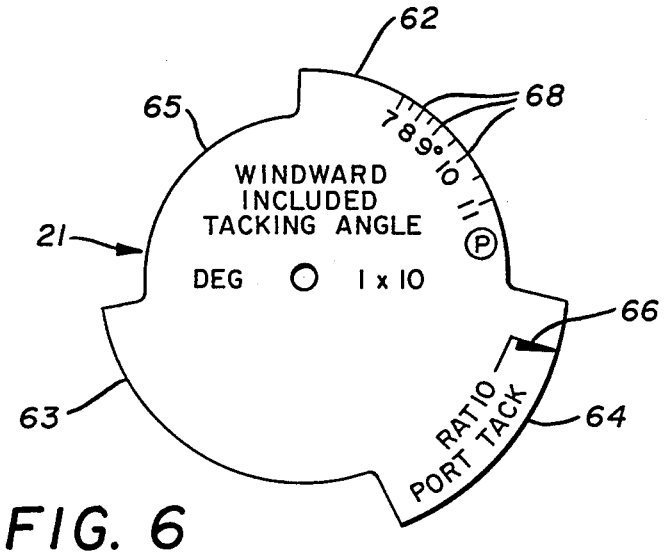
FIG. 6 is a view taken substantially along line 6—6 of FIG. 2 with the background disks omitted.

The outer periphery of disk member 21, individually depicted in FIG. 6, is defined by four arcuate edges 62, 63, 64 and 65. The diametrically disposed edges 62 and 63 have the same radius as the first outer edge 58 on disk member 20, and the edge 64 has the same radius as the second outer edge 59 on disk member 20. The edge 65 has a lesser radius than the edges 62 and 63. Specifically, the radius of edge 65 is sufficiently small to permit the divisions 60 imprinted in close proximity to the outer edge 58 on disk member 20 to be seen when the disk member 21 is mounted over the disk member 20 on the supporting post 12. A port tack ratio arrow 66 and the indicia RATIO PORT TACK are imprinted adjacent the outer edge 64. The port tack arrow 66 is utilized to point to values appearing in the sine/cosine set 39 on disk member 16, as will also be hereinafter more fully explained. The indicia comprising the letter "P" (employed as an abbreviation for "port") circumscribed by a circle is located adjacent one end of a plurality of radially oriented divisions 68, graduated in ten degree increments, also to represent the included tacking angle for the particular yacht with which the calculator 10 is being used. As such, the divisions 68 designate the angles 70° through 110°—again wih the "0" unit designation being omitted to reduce clutter. The "P" circumscribed by a circle and the divisions 68 are imprinted in close proximity to the outer edge 62. The disk 21 also has the indicia WINDWARD INCLUDED TACKING ANGLE and DEG and 1×10 imprinted thereon.

The disk members 17-21 can be rotated on the supporting post 12 in compliance with the hereinafter included operating instructions. However, a knurled thumb nut 70, or similar fastener such as a wing nut, is threaded onto the supporting post 12 and can be loosened to facilitate selective rotation of the disk member 17–21 on the supporting post 12. Conversely, the thumb screw 70 can be tightened to preclude inadvertent rotation of the disk members.

For the purposes of explaining the operation of the computer 10, it is assumed that it is being used to determine the best course to the windward mark in a sailing race. Prior to the start of the race the following information is obtained:

(a) The wind direction;
(b) The course direction—i.e., the compass heading to the windward mark;
(c) The included tacking angle;
(d) The distance to the windward mark; and,
(e) The estimated, or known, boat speed over the bottom while sailing to windward.

The following values have been arbitrarily assumed and are provided merely for purposes of facilitating the operational explanation which follows:

(a) Wind direction: 350° magnetic;
(b) Course direction: 5° magnetic;
(c) Boat speed: 5 MPH;
(d) Distance to the mark: 6 miles; and,
(e) Included tacking angle: 90°.

The included tacking angle is determined by sailing the boat to windward and taking compass readings while tacking from port to starboard and/or vice versa. The vast majority of boats will exhibit an included tacking angle of approximately 90°.

The wind direction is determined by turning the bow of the boat into the wind until the main boom is aligned with the center of the boat and then reading the compass. It is the duty of the Race Committee to establish the compass heading to the marks. Boat speed can be closely approximated with a knot meter or may be estimated by the yachtsman on the basis of his experience with a particular yacht.

It should be appreciated that for absolute accuracy one should employ the speed, or distance, relative to a fixed reference, such as over the bottom, rather than through a perhaps moving reference, such as the body of water on which the yacht is being sailed. As such, instrumentation such as a Loran C can provide the desired information relative to the bottom. Knot meters, log meters, or the like, provide a fairly accurate measurement of speed/distance through the water, but such devices provide only estimates of the actual speed/distance relative to the bottom inasmuch as they do not correct for tides, currents and/or leeward boat drift.

Certainly, if the effects of tide, current and/or boat drift are known, the skilled yachtsman can apply appropriate corrections to the speed/distance information to approach perfection, but even if that information is not known, the speed/distance through the water will generally provide sufficiently accurate results to be employed with a calculator 10 embodying the concepts of the present invention.

It should be further appreciated that the distance to the first mark may also be provided to the yachtsmen by the Race Committee.

With this information the calculator 10 can be used to determine the best course to the windward mark. For an orderly preparation of the calculator 10 the helmsman, or navigator, first aligns the course arrow 35, the true wind arrow 30 and the "0" designation on the compass rose 34.

With the thumb nut 70 loosened, the disk members 18 and 19 are each set at one-half of the included tacking angle (45° in this example) in opposite directions from the true wind arrow 30. That is, the starboard heading arrow 46 is aligned with 315° on the compass rose 34, and the port heading arrow 55 is aligned with 45° on the compass rose 34. The disk member 20 may then be rotated until the 90° designation ("9" on the indicia following the letter "S" circumscribed by a circle) of the included angle divisions 60 is aligned with the inner end of the starboard heading arrow 46. The disk member 21 may be similarly rotated until the 90° designation ("9" on the indicia following the letter "P" circumscribed by a circle) of the included angle divisions 68 is aligned with the inner end of the port heading arrow 55. The thumb nut 70 may then be tightened to fix the relative positions of the disks 18, 19, 20 and 21. The foregoing describes the orientation of the disk members 14, 15 16, 18, 19, 20 and 21 represented in FIG. 1.

The disk member 15 is then rotated until the true wind arrow 30 is aligned with the wind direction. In the example given the true wind is blowing from 350° on the compass rose 34. Even with the thumb nut 70 tightened the disk member 15 will rotate relative to the disk members 18–21.

Thereafter, the disk member 16 is rotated until the course arrow 35 is aligned with the course heading of 5° on the compass rose 34. The disk member 16 is rotated relative to all of the other disk members during this maneuver. After thus positioning disk member 16, the components of the calculator 10 are in the relative dispostions depicted in FIG. 7.

The tack ratios can now be read from the ratio arrows 61 and 66 on the disks 20 and 21, respectively. In the example represented in FIG. 7, the values are 0.5 for the starboard tack ratio and 0.87 for the port tack ratio. The starboard and port headings are also depicted by the heading arrows 46 and 55, respectively. In the example given, the starboard tack heading is 305° on the compass rose 34, and the port heading is 35° on the compass rose 34. These are the compass headings that must be maintained under the wind conditions given while the yacht is being sailed to the windward on the respective tacks. The yachtsman can quickly determine if any change in wind direction has occurred by noting if the respective tack headings cannot be most advantageously maintained. Specifically, the sails will either luff, if the designated heading points the yacht too close to the eye of the wind, or the sails will stall, if the designated heading is too far from the eye of the wind to be sailed most advantageously close hauled. In either situation the calculator 10 can be readily adjusted to reflect a change in wind direction.

A change in the wind direction will, of course, change the tack ratios.

Figure 8:
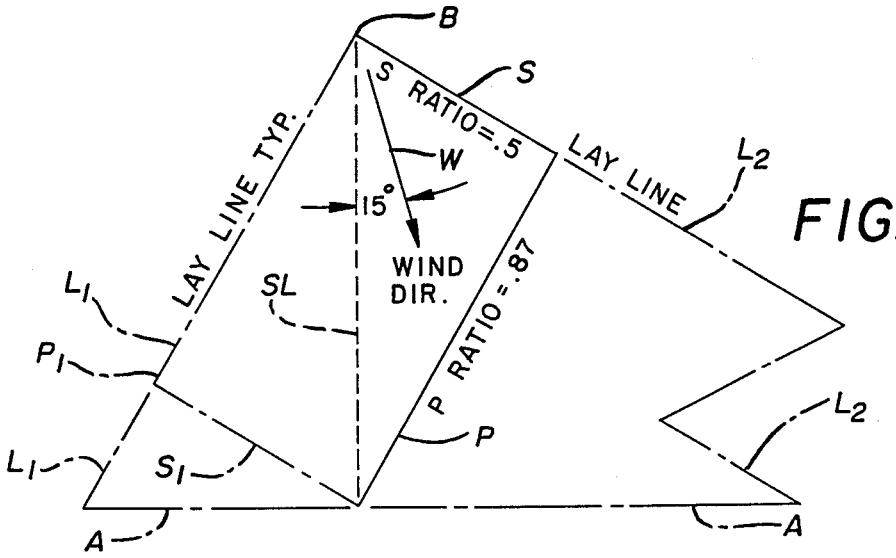
FIGS. 8, 9 and 10 are graphic representations of a windward leg that can be sailed between marks "A" and "B"
Figure 9:
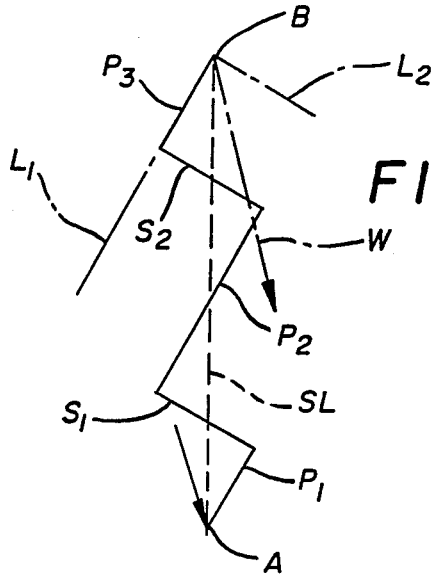
Figure 10:
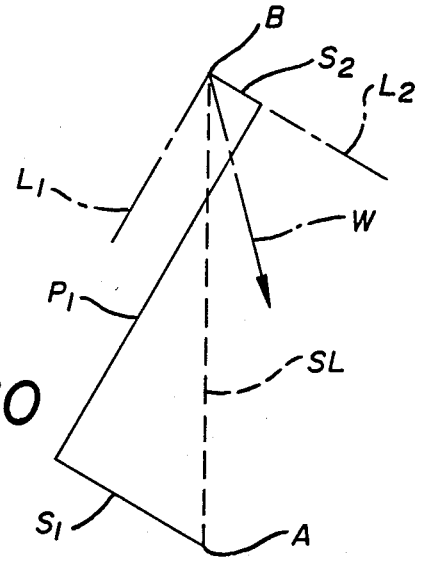

FIGS. 8 through 10 represent three courses that the yacht might sail to reach the windward mark "B" from the starting line "A". As can be seen in these FIGS., the lay lines "$L_1$" and "$L_2$" will intersect extensions of the start line "A." These three lines, all of which are imaginary, form a right triangle in the situation where the included tacking angle is equal to 90°.

As previously noted, the included tacking angle is not always equal to 90°. The mathematical relationships employed to determine the tack ratios were predicated on the trigonometric functions for a right triangle, with the 90° angle being the included tacking angle. Nevertheless, as the included tacking angle increases or decreases from the assumed standard 90°, the included tacking angle divisions 60 and 68 on disks 20 and 21, respectively, will, to a large measure, accommodate for the trigonometric assumption of a right triangle because the divisions on either side of the 90° mark were empirically determined. The accommodation is fully acceptable in that no more than a 2% to a 4% error is introduced, even at the maximum deviation from the accepted 90° included tacking angle, so long as the actual included tacking angle is set into the calculator 10, as previously described.

Inasmuch as most yachts cannot be steered closer than 5° to the desired course, especially in rough water and/or shifting winds, the error introduced at the maximum deviation from a 90° included tacking angle is relatively minor and can be ignored. Because the vast majority of yachts tack through an included angle of approximately 90°, and in order to facilitate the operational explanation which follows, a 90° tacking angle will be employed in the examples explained.

It should also be appreciated that the orientation of the triangle will change if the wind direction, represented by the arrow "W," changes. As depicted the true wind "W" is 15° off the straight line "SL" alignment of "A" to "B."

In FIG. 8 the yacht is represented as reaching the windward mark "B" with only one tacking maneuver. From the start line "A" the yacht sails on a port tack "P" for 0.87 (the port tack ratio) multiplied by 6 (the distance in miles from "A" to "B" along line "S"), which is equal to 5.22 miles. Because the yacht travels at 5 miles per hour the port tack is held for 63 minutes, which was calculated as follows:

$$[(6/5)(60*0.87)]=63$$

The yacht then remains on the starboard tack "S" for 0.5 (the starboard tack ratio) multiplied by 6 (again the distance from "A" to "B"), which is equal to 3 miles. This tack is held for 36 minutes, which was similarly calculated as follows:

$$[(6/5)(60*0.5)]=36$$

Therefore, it is only necessary to use a timing device to time the port tack and then to time the starboard tack. The order of the tacks to be sailed is, under ideal conditions, irrelevant. As such, the foregoing example could have been sailed with the yacht starting on starboard tack "$S_1$" and sailing for 36 minutes, and then sailing on port tack "$P_1$" for 63 minutes. Either of these courses will take the yacht to a lay line on the first tack. The yacht would then sail along the lay line to the mark.

A great many courses could be sailed within the rectangle defined by these two courses. Some of these courses are shown in FIGS. 9 and 10. The exact course sailed will depend on a number of conditions. For example, the wind force on one side of the course might be stronger, or it may be prognosticated that a favorable wind shift will likely be encountered on one side of the course in view of the surrounding terrain.

In FIG. 9 the yacht is sailed on three port tacks $P_1$, $P_2$ and $P_3$, respectively, and two starboard tacks $S_1$ and $S_2$, respectively. The yacht would remain on the first and third port tacks for 15.75 minutes and on the second port track for 31.5 minutes or a total of 63 minutes. The yachts stays on each starboard tack for 18 minutes or a total of 36 minutes. The cumulative times must be recorded so that the yachtsman can determine the remaining times to be spent on each tack.

In FIG. 10 the yacht makes random tacks to sail two starboard tacks $S_1$ and $S_2$ and one port tack $P_1$. In this situation the yachtsman must keep track of the cumulative time spent on the starboard and port tacks, respectively. The yacht must not remain on the cumulative starboard tacks for more than 36 minutes or the lay line will be crossed and the yacht will have to sail more than the 8.22 miles—which is the shortest distance to the windward mark when a 90° included tacking angle is possible. Conversely, the yacht must not remain on the port tack for more than a cumulative total of 63 minutes.

Particularly, if the distance to the windward mark is not known, the yacht will likely make a number of relatively short tacks as shown in FIG. 9. In any event, a yacht is sailed on successive tacks for times proportional to the values of the tack ratios. In this example the yacht should remain on the port tack 1.75 times as long as it remains on the starboard tack. If the wind direction changes, the total starboard and port tacks can be resolved into two vectors which can be plotted to locate the present postion of the yacht. The tack ratios can be redetermined on the calculator, and the times to be spent on each tack from there to the mark can be established.

It can be shown that any combination of tacks can be undertaken as long as the cumulative time totals are not exceeded. The timing can be accomplished with a single stopwatch and some method of recording the cumulative time spent on each tack, or, more easily, with two stopwatches.

However, an even more desirable arrangement includes a pair of timers in which the cumulative times on both tacks are displayed simultaneously. Such a timer is further enhanced if it is capable of switching automatically from one timer to the other when the boat changes tacks. The automatic change may be accomplished through the use of a mercury switch which will actuate one timer while deactuating the other during a tacking maneuver. Because a yacht heels, or lists, to one side or the other while the yacht is on a tack, this change in the switch condition will occur as the boat changes tacks. Such a timing device will, without human intervention, keep an accurate account of the time on each tack and automatically change between tacks.

In the foregoing example, or in any case, the use of a log meter, or two separate starboard and port log meter readouts switched automatically from a common input (such as the resistance propeller commonly employed in conjunction with log meters) can also provide a reading of the distance traversed through the water. The currently rather common usage of Loran C on larger yachts can, of course, provide the greatest accuracy in determining the actual distance traversed by a yacht across the bottom, as previously explained.

In any event, a capsulated set of instructions may be imprinted on the reverse face 33 of disk member 14. A typical set of instructions might read as follows:

TO USE CALCULATOR

1. ESTABLISH "INCLUDED TACKING ANGLE" BETWEEN CLOSE-HAULED STARBOARD AND PORT TACKS.
2. LOOSEN KNURLED NUT AND SET STARBOARD AND PORT HEADING ARROWS TO 1/2 THE INCLUDED TACKING ANGLE ON EITHER SIDE OF THE WIND ARROW. MAINTAIN THESE POSITIONS UNTIL THE NUT IS RE-TIGHTENED
3. LINE UP THE "INCLUDED TACKING ANGLE" MARKS ON SCALES "S" AND "P" WITH STARBOARD AND PORT HEADING ARROWS, TIGHTEN NUT.
4. ALIGN THE TRUE WIND ARROW (TO) WITH WIND DIRECTION ON COMPASS ROSE (FROM).

5. ALIGN COURSE ARROW (TO DESTINATIONS) WITH THE APPROPRIATED DIRECTION ON COMPASS ROSE.
6. RATIOS OF TIME OR DISTANCE FOR STARBOARD AND PORT TACKS ARE INDICATED BY DESIGNATED ARROWS ON INNER SCALE.

Figure 11:
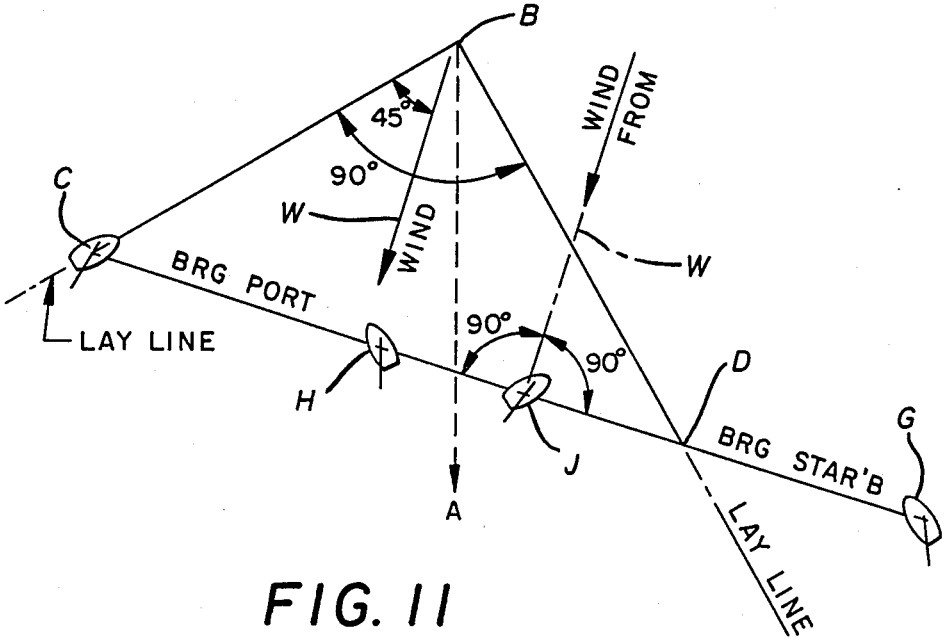
FIG. 11 is a graphic representation of the relative positions between two yachts on the race course.
Figure 13:
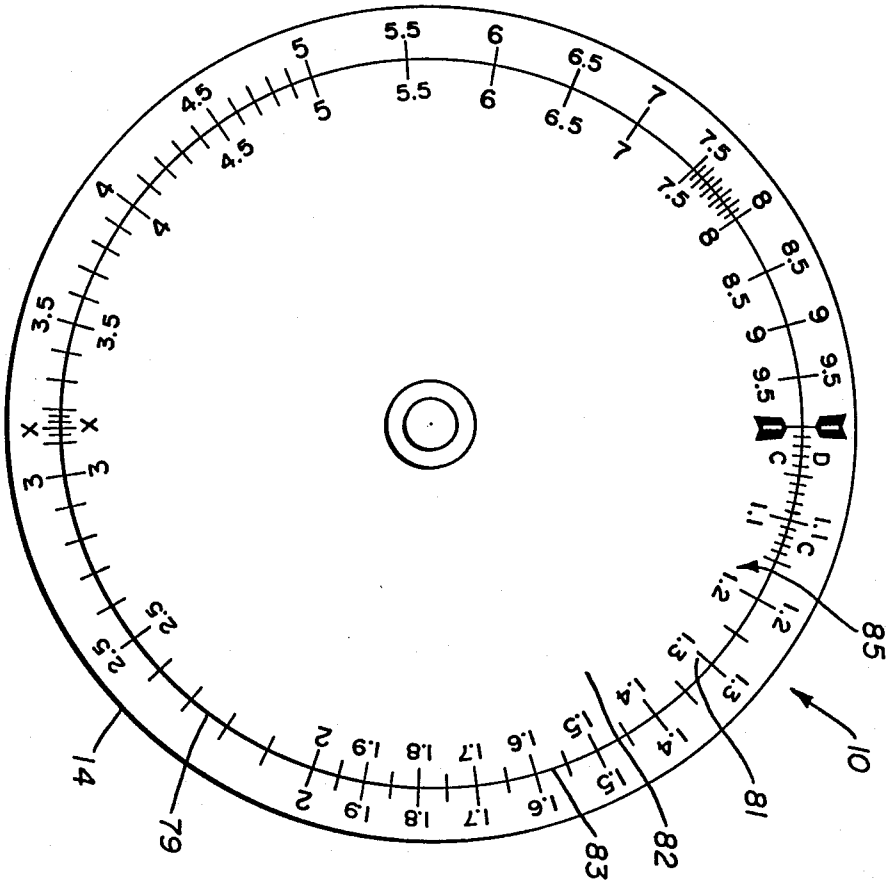

During the windward legs of a yacht race it is highly desirable for those on board any yacht to know their position relative to the other yachts in the race. FIG. 11 depicts assumed positions of yachts on the race course. Two bearings are taken from the yacht as position "J" which are 90° from the wind direction "W." The orientation of these bearings are represented by the bearing marks 34 and 36 on disk 12. In FIG. 11 these bearings are along line "C-D." Any yacht sailing within the triangle "CDB" is ahead of the yacht at "J." Any yacht below line "C-D" is behind the yacht at "J." The yachts at locations "C," "J" and "H" are even. The yacht at "G," however of the lay line "B-D." The location of yacht "G" outside the lay line, however, cannot be determined from the bearing which has been taken nor are the relative positions always accurate if a yacht is outside the lay line.

A brief set of instructions for determining whether a yacht is leading or lagging by the use of the calculator 10, which is perhaps not as appropriate to handicap racing, may also be imprinted on the reverse face 33 of the disk member 14. Such instruction might, for example, read substantially as follows:

FOR YACHTS HAVING SIMILAR TACKING ANGLES, THE CALCULATOR PROPERLY SET AND YOUR YACHT WITHIN THE LAY LINES, BEARINGS ON COMPETING YACHTS WHICH FALL BETWEEN THE STARBOARD AND PORT BEARINGS MARKS AND THE TRUE WIND ARROW INDICATE YOU ARE BEHIND.

IF THE BEARINGS ARE OUTSIDE OF THESE PARAMETERS, YOU ARE AHEAD!

Figure 12:
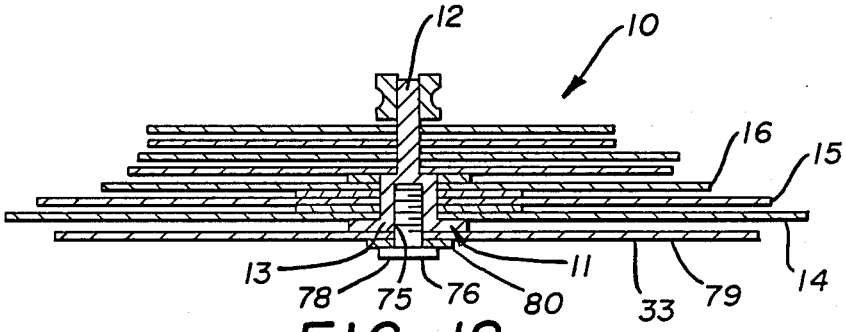
FIG. 12 is a cross sectional view similar to FIG. 2 but depicting an alternative embodiment of the present invention which incorporates a circular slide rule; and, FIG. 13 is a bottom plan view taken substantially along line 13—13 of FIG. 12.

In order to facilitate any mathematical calculations in the nature of multiplication or division, a circular slide rule may, if desired, be incorporated in the calculator 10. For example, as shown in FIG. 12 the hub portion 13 of the central support 11 may be bored and tapped, as at 75, to receive a threaded stud 76. The radially extending head 78 of the stud 76 can be employed to secure an eighth disk member 79 beneath the first disk member 14. A friction washer 80 may be interposed between the eighth disk member 79 and either the head 78 or the first disk member 14 in order to allow selective, but to preclude free, rotation of the eighth disk member 79 relative to the first disk member 14.

The eighth disk member 79 is of lesser diameter than the first disk member 14, and a scale 81, graduated logarithmically and labelled with corresponding antilogarithms, is imprinted on the exposed face 82 of the eighth disk member 79 adjacent the circular edge 83 thereof. A similar scale 84, graduated logarithmically and labelled with corresponding antilogarithms, is presented along a circular locus of point on the reverse face 33 of the first disk member 14. The circular locus of points on reverse face 33 is of slighly greater diameter than the diameter of the circular edge 83 on disk member 79 in order that the two scales 81 and 84 will be visually contiguous.

It should be apparent that if a circular slide rule, identified generally by the numeral 85, is to be provided, any instructions would be imprinted on the exposed face 82 of the eighth disk member 79 rather than on the reverse face 33 of the first disk member 14, as previously described.

Inasmuch as the calculator 10 is to be open to the elements it is preferable to construct it from materials that are resistant to the sun and salt water. Materials such as plastic or chrome plated bronze are, therefore, particularly useful for the manufacture of this computer. The plastic should also be resistant to ultraviolet radiation. These materials can be imprinted with indicia with any of the well known processes or methods of printing or embossing. The bronze material can have the indicia coined or otherwise struck or stamped into the proper surface.

As should now be apparent, the present invention not only provides an improved navigational calculator that is particularly suited for yacht racing but also otherwise accomplishes the objects of the invention.

I claim:

1. A navigational calculator comprising:

a plurality of disk members;

means to support said disk members and to permit said disk members to be selectively rotated with respect to each other;

a first of said disk members presenting a true wind indicator;

a second of said disk members presenting a compass rose;

said first and second disk members being relatively rotatable selectively to align said true wind indicator with the direction of said wind, as designated on said compass rose;

a third of said disk members presenting a course indicator and at least two sets of sine/cosine scales, said third disk member being rotatable with respect to said second disk member selectively to align said course indicator with respect to the appropriate course heading, as represented on said compass rose, while maintaining said true wind indicator properly aligned with said compass rose;

the alignment of said course indicator with the heading designated on said compass rose determining the angular disposition of said sine/cosine sets about the means to support said disk members;

a starboard heading indicator having a head portion and a tail portion, said head portion being selectively alignable with the directional representation on said compass rose;

a port heading indicator having a head portion and a tail portion, said head portion being selectively alignable with the directional representation on said compass rose;

a fifth disk member having angular indicia and a starboard tack ratio indicator, alignment of said angular indicia on said fifth disk member with the tail portion of said starboard heading indicator effecting alignment of the starboard tack ratio indicator along the scale of one of said sine/cosine sets;

a sixth disk member having angular indicia and a port tack ratio indicator, alignment of said angular indicia on said sixth disk member with the tail portion of said port heading indicator effecting alignment of the port tack ratio indicator along the scale of the other of said sine/cosine sets;

the readings designated by said tack ratio indicators on said sine/cosine sets reflecting the relative times, and distances, sailed on said starboard and port tacks, respectively, effectively to traverse the course designated by said true course indicator.

2. A navigational calculator, as set forth in claim 1, further comprising:

friction disks interposed between said first, second and third disk members.

3. A navigational calculator, as set forth in claim 2, further comprising:

means to selectively secure the remainder of said disk members against inadvertent rotation.

4. A navigational calculator comprising:

a plurality of disk members;

support means having a first of said disk members secured thereto and the other of said disk members being rotatably supported thereon;

a wind direction indicia on said first disk member;

a second of said disk members with a compass rose indicia presented therefrom;

another said disk member having a course indicia and two sets of sine/cosine indicia means representing the angles between 0° and 90°, ξε τεν disposed on either side of said course indicia;

a fourth of said disk members rotatably supported on said support means and having indicia means thereon in the nature of a starboard heading indicator;

a fifth of said disk members rotatably supported on said support means and having indicia means thereon in the nature of a port heading indicator;

a sixth of said disks rotatably mounted on said support means and having an included tacking angle indicia and a pointer indicia thereon;

a seventh of said disk members rotatably supported on said support means and having an included tacking angle indicia and a pointer indicia thereon; and, said second through seventh disk members being selectively rotatable in accordance with predetermined parameters not only to establish a starboard tack ratio designated by where said pointer indicia on one of said sixth and seventh disk members aligns with one of said sine/cosine indicia means on said third disk member but also to establish a port tack ratio designated by where said pointer indicia on the other of said sixth and seventh disk members aligns with the other of said sine/cosine indicia means.

5. A navigational calculator, as set forth in claim 4, further comprising:

friction means interposed between said first disk member, said second disk member and said third disk member.

6. A navigational calculator, as set forth in claim 5, further comprising:

manually operable means for selectively securing at least said fourth through said seventh disk members against inadvertent rotation.

7. A navigational calculator for establishing the ratios of time, or distance, to be spent on port and starboard tacks, respectively, during the maneuvering of a yacht to a windward destination comprising:

central supporting means;

a first disk means mounted on said central supporting means and having a true wind indicator imprinted thereon;

a second disk means mounted on said central supporting means and having an outer periphery of lesser dimension than said first disk means;

a compass rose imprinted on said second disk means;

a third disk means mounted on said central supporting means and having an outer periphery of still lesser dimension than said second disk means;

a course indicator and two sets of tack ratio indicia imprinted on said third disk means;

a fourth disk means mounted on said central supporting means and having an indicator imprinted thereon for selective alignment with said compass rose;

a fifth disk means mounted on said central supporting means and having an indicator imprinted thereon for selective alignment with said compass rose;

a sixth disk means mounted on said central supporting means and having an included tacking angle indica representing a plurality of angles and a ratio indicator alignable with one set of said tack ratio indicia;

a seventh disk means mounted on said central supporting means and having an included tacking angle indicia representing a plurality of angles and a ratio indicator alignable with the other set of said tack ratio indicia; and, means for maintaining said disk means in selected positions on said center post means.

8. A navigational calculator, as set forth in claim 7, wherein:

said indicators on said fourth and fifth disk means may be aligned with selected angular representations on said compass rose;

said tacking angle indicia on each of said sixth and seventh disk means may be aligned with respective indicators on said fourth and fifth disk means;

said true wind indicator may be aligned with the angular representation on said compass rose designating the wind direction; and, said course indicator may be aligned with the heading to the windward destination, as represented on said compass rose, in order to effect alignment of said ratio indicators on said sixth and seventh disk members with the respective tack ratio indicia on said third disk means.

9. A navigational calculator, as set forth in claim 8, wherein:

said central supporting means has a hub portion with a supporting post extending axially from said hub portion;

said first, second and third disk means are rotatably mounted on said hub portion;

said fourth through said seventh disk means are rotatably carried on said supporting post.

10. A navigational calculator, as set forth in claim 9, wherein said means for maintaining said disk means in selected positions on said center post means comprises:

a flange extending radially outwardly from said hub portion;

said first disk means being affixed to said flange;

friction disks interposed between said first, second and third said disk means.

11. A navigational calculator, as set forth in claim 10, wherein:

a retaining washer is received on said hub portion with said first, second and third disk means positioned between said flange and said retaining washer.

12. A navigational calculator, as set forth in claim 11, wherein:

said supporting post is threaded; and, nut means are threadably received on said supporting post selectively to secure at least said disk means positioned between said nut means and said retaining washer.

13. A navigational calculator, as set forth in claim 8, wherein:

a pair of bearing marks are provided on said first disk means;

one of said bearing marks is disposed on either side of said true wind indicator at 90° with respect thereto.

14. A navigational calculator, as set forth in claim 8, wherein:

said first disk member has a reverse face;

an eighth disk member is rotatably supported from said central support;

said eighth disk member has a circular edge and is disposed adjacent the reverse face of said first disk member;

a first logarithmic scale is presented on said eighth disk member adjacent said circular edge thereof;

a locus of points defines a circle on the reverse face of said first disk member;

a second logarithmic scale is presented along said locus of points on said first disk member to lie visually adjacent said first logarithmic scale on said eighth disk member.

15. A method of determining appropriate ratios of time, or distance, to be spent on starboard and port tacks while sailing to windward, said method being accomplished by the manipulation of seven disks and comprises the steps of:

aligning a wind direction indicator on one of the disks with the appropriate angular designation on a compass rose presented from a second of the disks;

setting a course direction indicator on a third disk in alignment with the direction of the course to be made good, as depicted on the compass rose presented from the second disk;

setting one end of an indicator on a fourth of the disks in alignment with a first predetermined position on the compass rose presented from the second disk to represent the angular relation of the yacht to the wind when sailing close hauled to starboard;

setting one end of an indicator on a fifth of the disks in alignment with a second predetermined position on the compass rose presented from the second disk to represent the angular relation of the yacht to the wind when sailing close hauled to port;

aligning a predetermined included tacking angle indicia on a sixth of the disks with the other end of the arrow indicia on the fourth disk;

aligning a predetermined included tacking angle indicia on a seventh of the disks with the other end of the arrow indicia on the fifth disk;

securing the fourth, fifth, sixth and seventh disks in the set positions;

reading a starboard tack ratio number from indicia on the third disk, as indicated by a pointer indicia on one of the sixth or seventh disks; and, reading a port tack ratio number from indicia on the third disk, as indicated by a pointer indicia on the other of the sixth or seventh disks.

* * * * *